United States Patent [19]

Yestadt et al.

[11] Patent Number: 4,561,692

[45] Date of Patent: Dec. 31, 1985

[54] ADJUSTABLE HEIGHT FURNITURE

[76] Inventors: James F. Yestadt, 666 Sixth Ave., New York, N.Y. 10010; Frederick J. Yestadt, 264 Lexington Ave., New York, N.Y. 10016

[21] Appl. No.: 507,227

[22] Filed: Jun. 23, 1983

[51] Int. Cl.[4] ..... A47C 3/20; A47C 9/00

[52] U.S. Cl. ..... 297/93; 108/12; 108/144; 297/1; 297/130; 297/344

[58] Field of Search ..... 108/12, 144; 297/1, 297/3, 93, 92, 118, 130, 344, 345; 182/33, 33.2

[56] References Cited

U.S. PATENT DOCUMENTS

| | | | |
|---|---|---|---|
| 2,269,834 | 1/1942 | Wagner | 182/33.2 |
| 3,967,562 | 7/1976 | Anacker | 108/144 X |

FOREIGN PATENT DOCUMENTS

| | | | |
|---|---|---|---|
| 38223 | 8/1909 | Austria | 297/1 |
| 880030 | 12/1942 | France | 108/12 |
| 1080007 | 12/1954 | France | 108/12 |
| 1406095 | 6/1965 | France | 108/144 |
| 598783 | 2/1948 | United Kingdom | 108/144 |

*Primary Examiner*—William E. Lyddane
*Assistant Examiner*—Peter R. Brown
*Attorney, Agent, or Firm*—Sixbey, Friedman & Leedom

[57] ABSTRACT

Adjustable height table and chair, useful as individual furniture pieces or in combination to form casual or dining furniture groupings, includes an adjustable height table having a table top and support elements therefor hingedly connected to the table top for relative pivotal movement, the support members being of generally rectangular cross-section and of considerably greater length than width such that when the table top rests on the short sides of the support members the table is of dining table height whereas when the support members are pivoted about the hinged connection such that the table top rests on the long sides of the support members the table top is of cocktail table height. An adjustable height chair is also provided which includes seat means supported on each side by generally rectangular cross-section support members for relative pivotal movement therebetween, the pivot axis being considerably further from one side of the support member than from the intersecting side such that when the chair is supported on a surface with the one side in contact with the surface the chair will be dining chair height whereas when the chair is supported with the intersecting side in contact with the surface the chair will be lounging chair height.

19 Claims, 10 Drawing Figures

ADJUSTABLE HEIGHT FURNITURE

DESCRIPTION

1. Technical Field

The present invention relates to adjustable height furniture and, more particularly to adjustable height tables and chairs for providing multiple functional uses for the tables and chairs.

2. Background Art

Furniture, such as tables, having multiple adjustable heights are well known in the prior art, particularly for decorative purposes and for the purposes of providing different utilitarian forms. Typically, the adjustability in height is achieved by providing folding support members or rotatable or re-orientable bases. U.S. Pat. Nos. 2,602,011—Sanders, 2,632,023—Frye and 2,757,998—Adler are illustrative and representative of adjustable height and function tables wherein the supporting base is rotatable, generally through 90°, to adjust the table height. With these type tables, the table top must be completely disassembled or separated from the base before the base can be rotated or re-oriented to effect the height change, and then the table top must be reassembled to the base prior to use. There are adjustable height and function tables wherein the table top retains affixed to the base during table height adjustment. However, these are generally more complex in construction, more expensive in terms of materials and more difficult to use in terms of ease of adjustment. For example, U.S. Pat. No. 4,106,413—Hoaglund discloses a multi-position table comprising a table top and a pair of triangular cross-section support structures hingedly attached to opposite ends of the table top and pivotable to provide three table top heights, at least two of which have reduced table top surface areas relative to the third. By way of further example, U.S. Pat. No. 2,253,777—Gipson discloses an adjustable height and function table comprising a table top and a table base support structure supported thereunder providing slotted recesses for slidably and rotatably receiving a pin fixed in a rectangular table base. Each time the table height requires adjustment the table top is lifted to allow the base to reposition itself under the table top by sliding in the recess and then rotating about the pin to place a different length pair of opposite sides into supporting contact with the table top and the floor.

It is therefore the purpose of the present invention to overcome the disadvantages and difficulties associated with known adjustable height furniture.

DISCLOSURE OF THE INVENTION

In one aspect of the invention this purpose is accomplished by providing adjustable height furniture, such as tables and chairs, which are ruggedly built and stable, simple to manufacture and use, relatively inexpensive and readily operable to adjust height and function without disassembly of the furniture.

In another aspect of the invention this is accomplished by providing an adjustable height table having a table top and a table top support structure, the table top support structure comprising at least two spaced support elements and pivot means pivotally connecting said support elements to the underside of the table top for pivotal movement of each said support element about a pivot axis, each said support element having a pair of opposite relatively short sides and a pair of opposite relatively long sides defining a generally rectangular cross-section in a plane generally perpendicular to its pivot axis, said support elements being pivotable about their respective pivot axes between a first position wherein a long side of each support element contacts the underside of said table top and a second position wherein a short side of each support element contacts the underside of said table top, whereby said table has a greater height in said second position and a lesser height in said first position of said support elements.

In still another aspect of the invention this is accomplished by providing an adjustable height chair adapted to be supported on a chair supporting surface having a seat means and a seat means support structure, the seat means support structure comprising first and second support members arranged on opposite sides of said seat means and first and second pivot means having first and second generally parallel pivot axes for pivotally connecting said support members to said seat means, each said support member having a pair of opposite first sides and a pair of opposite second sides defining a generally rectangular cross-section in a plane generally perpendicular to its pivot axis, said support members being pivotable relative to said seat means about their respective pivot axes between a first position wherein a first side of each support member contacts the chair supporting surface and a second position wherein a second side of each support member contacts the chair supporting surface, the distance between each said pivot axis and each said first side contacting said chair supporting surface being greater than the distance between each said pivot axis and each said second side contacting said chair supporting surface, whereby said chair has a greater height in said first position and a lesser height in said second position.

In yet another aspect of the invention this is accomplished by providing an adjustable height furniture unit comprising an adjustable height table and at least one adjustable height chair, said table and chair being adjustable between greater and lesser heights relative to a support surface, said table at its greater height being functionally compatible with said chair at its greater height and said table at its lesser height being functionally compatible with said chair at its lesser height.

BRIEF DESCRIPTION OF THE DRAWINGS

The invention will be better understood from the following description taken in conjunction with the accompanying drawings in which.

BEST MODE FOR CARRYING OUT THE INVENTION

Figure 1:
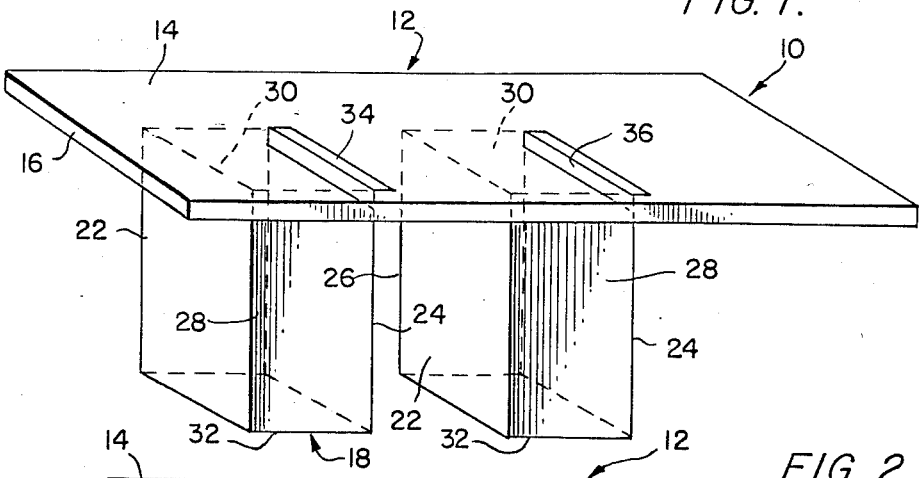
FIG. 1 is a perspective view of one form of adjustable height table of the present invention in its greater height position.
Figure 2:
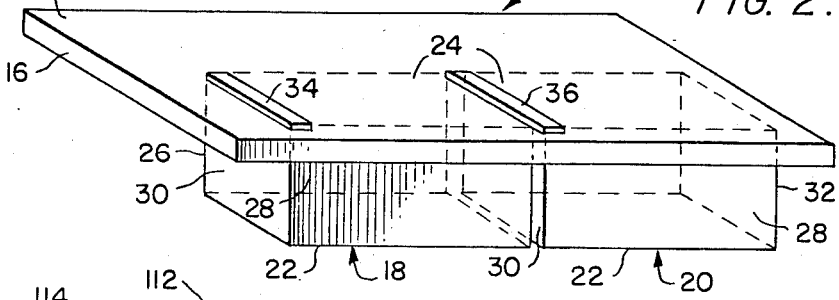
FIG. 2 is a perspective view of the adjustable height table of FIG. 1 in its lesser height position.

Referring first to FIGS. 1 and 2 one form of adjustable height table 10 of the present invention is shown. A table top 12 having a top surface 14 and a bottom surface 16 is supported on a pair of blocks 18,20 comprising the table support structure. The blocks 18,20 consist of three pairs of opposite rectangular faces, specifically front and rear faces 22,24, side faces 26,28 and end faces 30,32. Table top 12 is pivotally attached at hinges 34,36 to blocks 18,20, respectively. Hinges 34,36 are preferably conventional spring-type hinges but may be piano-type hinges or any other well known conventional hinge. The hinges 34,36 extend across the block edge defined by the intersection of faces 24 and 30 with the hinge plates attached to the portions of face 24 adjacent the edge and to bottom surface 16.

The length of each face 24 and 30 between the hinged edge and the opposite edge determines the height of the table in each of its adjusted positions and, therefore, the face lengths are carefully selected to provide useful table height dimensions. For example, the length of face 24 is typically selected to provide a table height suitable for dining tables whereas the length of face 30 is typically selected to provide a table height suitable for a casual table, such as a coffee or cocktail table. Table top 12 may be of any convenient width but the table top length, i.e., the dimension perpendicular to the pivot axes defined by hinges 34,36, must be such that the distance between hinges 34,36 is maintained to allow sufficient clearance for blocks 18,20 to pivot beneath table top 12 and to accomodate the maximum block dimension, i.e., the length of face 24, between the hinges.

In operation, table 10 may be selectively adjusted to one of the positions shown in FIGS. 1 and 2 by pivoting blocks 18,20 about their respective hinges 34,36. In the position shown in FIG. 1, table 10 is in its greater height position and is adapted for use, for example, as a dining table with the bottom surface 16 of table top 12 supported on end face 30 of each block 18,20 and with table 10 supported on a table supporting surface (not shown) on end face 32. In this arrangement, the length of face 24 plus the thickness of table top 12 determines the height of table 10. When blocks 18,20 are pivoted 90° with reference to the table top about their respective hinges 34,36 to form the lesser height table position shown in FIG. 2, the table 10 is adapted for use, for example, as a coffee or cocktail table. In this position the bottom surface 16 of table top 12 is supported on rear face 24 and table 10 is supported on a table supporting surface (not shown) on front face 22. The height of table 10 is determined, in this arrangement, by the length of face 30 plus the thickness of table top 12.

The table support structure, illustrated in FIGS. 1 and 2 as spaced blocks 18,20, may comprise blocks of identical dimensions as well as blocks which have different width dimensions, i.e., the width dimension of faces 22 and 24 between faces 26 and 28. However, in order to impart stability to the table, block dimensions such as the length of faces 24 and 30, must be the same for all blocks comprising the table base structure. However, the table base structure need not be spaced blocks, as shown in FIGS. 1 and 2. Equally suitable, for example, is a base structure wherein pairs of side-by-side spaced apart slabs are substituted for the blocks as shown in FIGS. 3 and 4.

Figure 3:
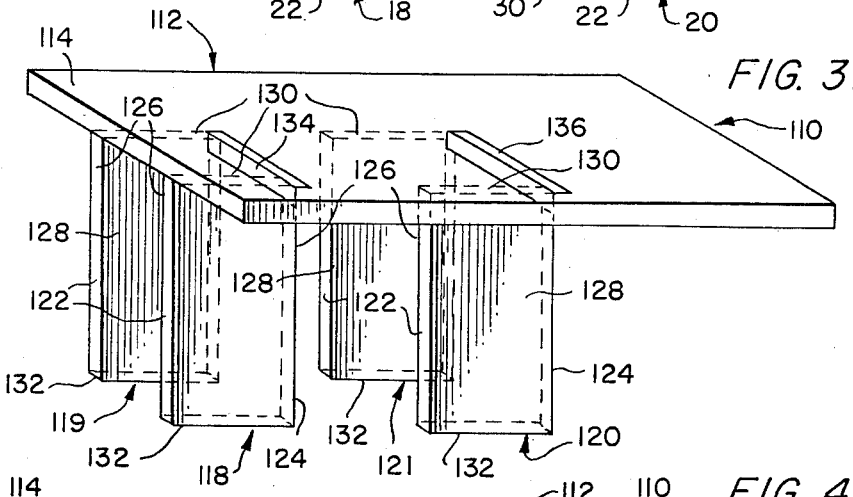
FIG. 3 is a perspective view of another form of adjustable height table of the present invention in its greater height position.
Figure 4:
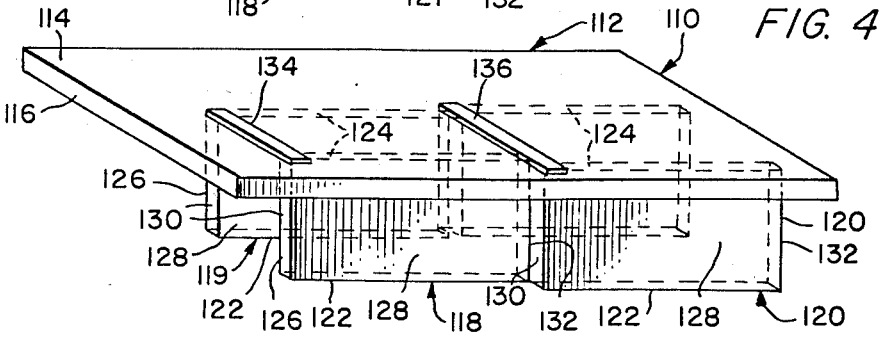
FIG. 4 is a perspective view of the adjustable height table of FIG. 3 in its lesser height position.

The adjustable height table 110 of FIGS. 3 and 4 consists of a table top 112 having a top surface 114 and a bottom surface 116 supported on slabs 118,119, 120,121 arranged as side-by-side spaced pairs 118-119 and 120-121 with the pairs spaced along the length of table 110 in the same manner as the blocks 18,20 were spaced along the length of table 10. Each slab 118,119,120,121 consists of three pairs of opposite rectangular faces, specifically front and rear faces 122,124, side faces 126,128 and end faces 130,132. Table top 112 is pivotally attached at hinge 134 to slabs 118,119 and at hinge 136 to slabs 120,121. The hinges 134,136 extend across the slab edges defined by the intersection of faces 124 and 130 with the hinge plates attached to the portions of faces 124 and 130 adjacent each edge. As with table 10, the length of each face 124 and 130 determines the height of the table 110 and sufficient clearance is maintained between hinges 134,136 for slabs 118,119 to pivot beneath table top 112 and to accomodate the maximum slab dimension between the hinges. Table 110, is shown in its greater height position, for example the dining table position, in FIG. 3 with the bottom surface 116 of table top 112 supported on end face 130 of each slab 118,119,120,121, with the table 110 supported on a table supporting surface (not shown) on end face 132 of each slab 118,119,120,121 and with the height of table 110 determined by the length of face 124 plus the thickness of table top 112. When slabs 118,119,120,121 are pivoted 90° with reference to table top 112 about their respective hinges 134,136, table 110 assumes its lesser height position, for example a coffee or cocktail table position, shown in FIG. 4 with the bottom surface 116 of table top 112 supported on rear face 124 of each slab, table 110 supported on a table supporting surface (not shown) on front face 122 of each slab and the height of table 110 determined by the length of face 130 plus the thickness of table top 112.

It will be appreciated that the table construction of the present invention utilizes a fundamental geometry which allows the table top to be raised and lowered while remaining parallel to the floor. Further, it allows the height of the table top to be adjusted while remaining attached to the table support structure. It will also be appreciated that the table top support structure need not comprise conventional four-sided support elements as long as the fundamental geometry remains, i.e., each element includes a pair of definable opposite relatively short sides and a pair of definable opposite relatively long sides defining a generally rectangular cross section in a plane generally perpendicular to the pivot axis. Thus, the individual sides need not be flat or planar but may be arcuate or comprise one or a number of interconnectable perimeter support points, e.g., a single point through which an imaginary perimeter line may be drawn or a series of interconnected tooth-like or arcuate projections. When these perimeter support points are interconnected by a real or imaginary straight line to define a side the resulting shape completely circumscribes the support element shape with the straight lines defining the "sides" of the support element. The table top as well as the blocks or slabs comprising the table support structure, may be constructed of any material typically employed in furniture manufacture and of new and novel materials not generally so employed. Thus, the tables may be formed, for example, of wood, fibrous materials, metal, glass, plastic, ceramics, and the like, including combinations of the foregoing. Table construction may employ solid materials, panels, laminates, honeycomb slabs and the like, including various combinations.

The height adjustability of the table structure of FIGS. 1–4 permits the user to adapt the table to a variety of uses suitable for various occasions. This adjustability of table function may be aided, enhanced and complemented by a comparable adjustable function chair which is also characterized by height adjustability. Thus, the present invention also provides an adjustable height and function chair which is functionally compatible with the greater and lesser heights of the adjustable height table of FIGS. 1–4 and which is convertible, for example, between a dining chair suitable for use with the table as shown in FIGS. 1 and 3 and a lounging chair suitable for use with the table as shown in FIGS. 2 and 4.

Figure 6:
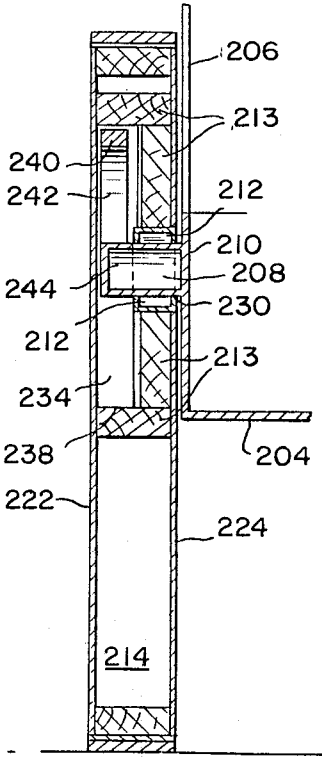
FIG. 6 is a partial sectional view taken substantially along line 6—6 in FIG. 5.
Figure 5:
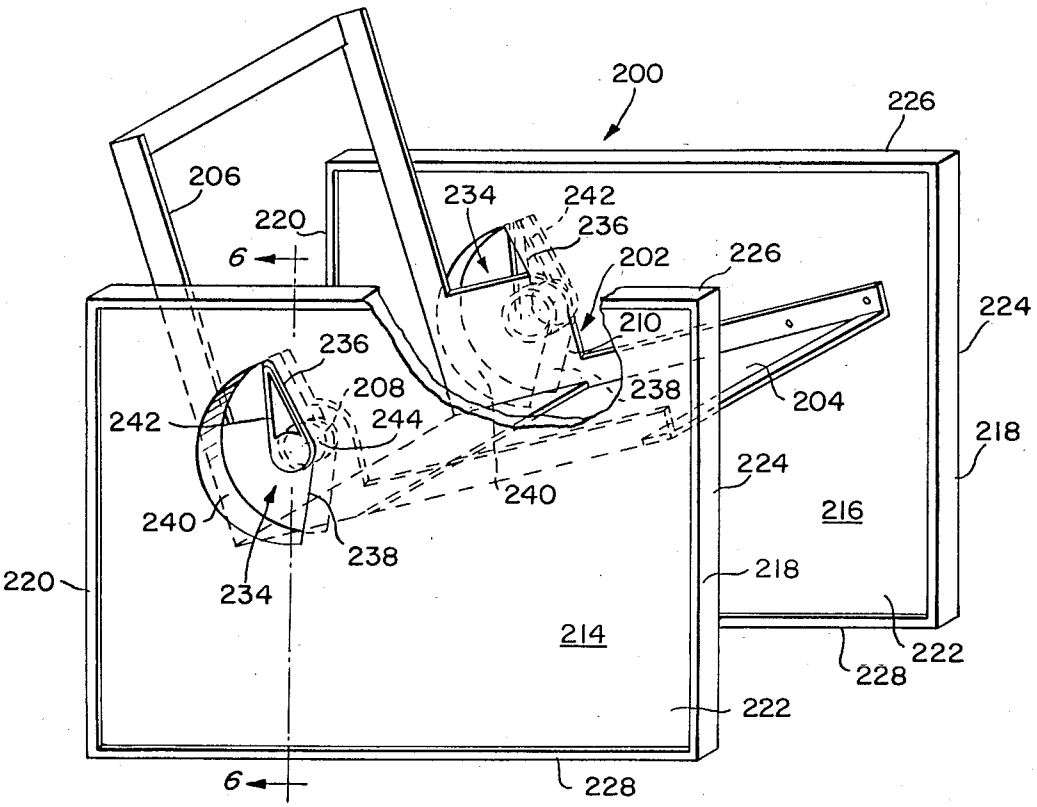
FIG. 5 is a perspective view, with portions broken away, of one form of adjustable height chair of the present invention.
Figure 7:
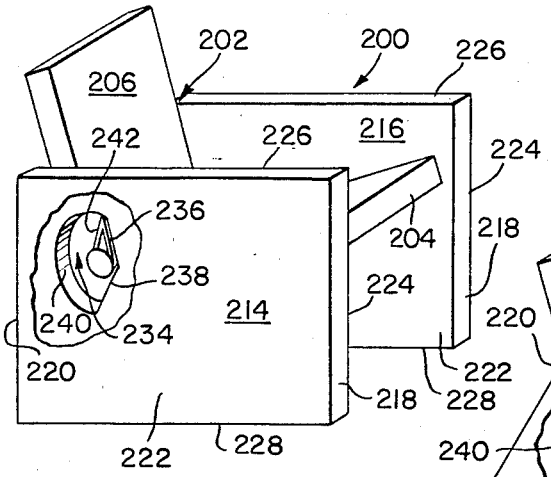
FIG. 7 is a perspective view, with portions broken away, of one form of adjustable height chair of the present invention in its lesser height position.

Referring now to FIGS. 6 and 7 there is shown the adjustable height and function chair 200 of the present invention which is adapted for conversion between a greater height chair, such as a dining chair having a seat height above the floor of about 17 inches, and a lesser height chair such as a lounging chair having a seat height above the floor of about 15 inches. In its lounge position, chair 200 consists of seat means 202 having a seat portion 204 intersecting at an angle a back support portion 206 and defining therebetween a seating area arranged to comfortably accomodate an occupant of the chair. The seating area may be constructed of any materials typically employed in furniture manufacture and desirably is formed of a rigid, i.e. metal or plastic, supporting frame adapted to receive seat and back supporting materials thereon. Pivot shafts 208 project sidewardly from plates 210 which are formed integrally with or attached to each side of seat means 202 and bridge the intersection of seat portion 204 and back supporting portion 206. Pivot shafts 208 rotate in roller bearing assemblies 212 fixedly mounted, for example by wood blocking 213, in support slabs 214,216 for pivotally connecting seat means 202 to support slabs 214,216. The slabs 214,216 comprise three pairs of opposite rectangular faces, specifically front and rear faces 218,220, side faces 222,224 and top and bottom faces 226,228. Seat means 202 is pivotally connected to and mounted on support slabs 214,216 via pivot shafts 208 projecting into roller bearing assemblies 212 through openings 230 defined in side faces 224 of slab 214 and 222 of slab 216. Shafts 208 extend through the roller bearing assemblies 212 into the vertex 232 of arcuate recesses 234 formed in slabs 214,216 between side faces 222 and 224. Each arcuate recess 234 is desirably in the form of a sector of a circle and comprises a pair of radial walls 236,238 extending from vertex 232 and joined at their ends by arcuate wall 240. A pivoting stop member 242 is rigidly affixed to the end portion 244 of shaft 208 for pivotal rotation in the arcuate path defined by arcuate recess 234 between end stops defined by radial walls 236,238. In this manner the relative pivotal rotation between seat means 202 and slabs 214,216 is limited to 90°–180° by the included angle between radial walls 236,238.

Figure 8:
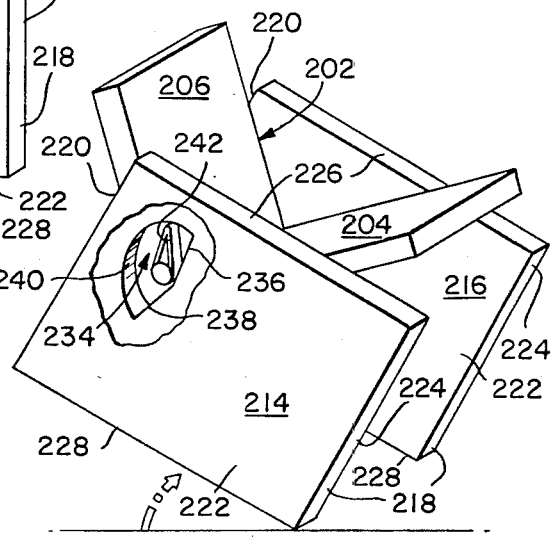
FIGS. 8 and 9 are perspective views of the chair of FIG. 7 in various stages of pivotal movement between its lesser and greater height positions.
Figure 9:
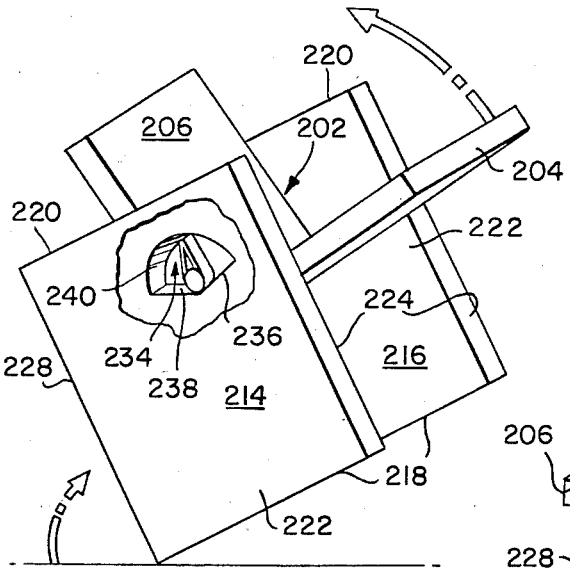
Figure 10:
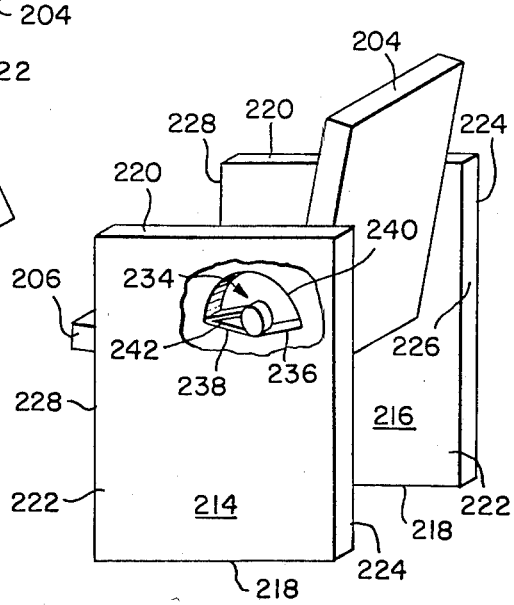
FIG. 10 is a perspective view, with portions broken away, of the adjustable height chair of FIG. 7 in its greater height position.

In operation, chair 200 may be selectively adjusted to one of the positions shown in FIGS. 8 and 11 by pivoting slabs 214,216 about their respective pivot shafts 208 and then pivoting seat means 202 to the appropriate stop position. In the position shown in FIG. 8, chair 200 is in its lesser height position and is adapted for use, for example, as a lounging chair with seat means 202 pivotally supported via shafts 208 in side slabs 214,216 and chair 200 supported on a chair supporting surface (not shown) on bottom faces 228 of slabs 214,216. In this arrangement, pivoting stop member 242 abuts radial wall 236 (lounging chair end stop) and the distance between the pivot axes, defined by shafts 208, and bottom faces 228 determines the height of chair seat portion 204. To convert chair 200 to its greater height, in the position illustrated in FIG. 11, for example for use as a dining chair, side slabs 214,216 are pivoted about shafts 208 in a clockwise direction as shown by the clockwise pointing arrows in FIGS. 9 and 10 until a 90° rotation relative to the chair supporting surface is completed, placing front faces 218 of slabs 214,216 in contact with the chair supporting surface for supporting chair 200 thereon. At this point, pivoting stop member 242 has also pivoted 90° relative to radial wall 236 and is disposed within arcuate recess 234 between radial walls 236 and 238. To complete the conversion to the dining chair position of FIG. 11, seat means 202 is pivoted counter-clockwise as shown by the counter-clockwise directed arrow in FIG. 10 until pivoting stop member 242 abuts radial wall 238 (dining chair end stop). In this arrangement, the distance between the pivot axes, defined by shafts 208, and front faces 218 determines the height of chair seat portion 204. To return chair 200 to the position of FIG. 8 it is only necessary to reverse this chair height conversion procedure.

Depending upon the angle defined by radial walls 236,238, the seat means 202 in the dining chair position may be supported in slabs 214,216 more uprightly than in the lounging chair portion, i.e., with seat portion 204 defining a smaller angle with the horizontal. Such a position provides a different anatomical support emphasis than in the lounging chair position, favoring lumbar support by contrast with a lounging chair which favors thigh support. In addition, inasmuch as the pivotal movement of seat means 202 effectively interchanges the function of seat portion 204 and back supporting portion 206, by making seat portion 204 and back supporting portion 206 different lengths, the anatomical support points on the occupant's body will be different for the dining chair and lounging chair positions.

Industrial Applicability

The adjustable height furniture of the present invention lends itself to a wide variety of combinations which permit the user to adapt the furniture to various occasions. Thus by providing an adjustable height table having support elements of generally rectangular cross section and of considerably greater length than width, so that when the table top rests on one of the sides of the support elements the table will be of dining table height whereas when the table top rests on one of the other sides of the support elements the table will be considerably lower, generally of cocktail or coffee table height, an adjustable function table is in fact provided. Likewise, by providing an adjustable height chair having support members of generally rectangular cross section and a pivot axis which is considerably further from one side of the support members than from the intersecting side of the support members, so that when the chair is supported on a surface with the one side in contact with the surface the chair seat will be dining chair height whereas when the chair is supported with the intersecting side in contact with the surface the chair seat will be lounging chair height, an adjustable function chair is, in fact, provided.

The adjustable height furniture is, of course, broadly useful for providing multiple function, convertible tables and chairs but is particularly useful as an ensemble or combination table and chair unit in which the table and chairs are each convertible to complement the function of the other and thus provide a useful and multiple function furniture grouping rather than merely individual pieces. In this connection when the table is adjusted to cocktail table height the chairs are advantageously adjusted to lounging chair height to provide a casual furniture grouping for informal gatherings. On the other hand, when the table is adjusted to dining table height the chairs are advantageously converted to dining chair height, in which the chair seat portions are adapted to be disposed under and spaced below the underside of the table, to provide a set for accomodating a more upright posture for activities such as dining, gaming, conferences, etc.. In particular, the table and chair unit of the present invention is usefully convertible to provide both the necessary casual furniture while a gathering is informally social and the primary activity is casual conversation and the necessary alternate furniture when the primary activity of the gathering switches to dining, gaming, conferencing, and the like.

We claim:

1. An adjustable height chair adapted to be supported on a chair supporting surface having a seat means and a seat means support structure, the seat means support structure comprising first and second support members arranged on opposite sides of said seat means and first and second pivot means having first and second generally parallel pivot axes for pivotally connecting said support members to said seat means, each said support member having a pair of opposite first sides and a pair of opposite second sides defining a generally rectangular cross-section in a plane generally perpendicular to its pivot axis, said support members being pivotable relative to said seat means about their respective pivot axes between a first position wherein a first side of each support member contacts the chair supporting surface and a second position wherein a second side of each support member contacts the chair supporting surface, the distance between each said pivot axis and each said first side contacting said chair supporting surface being greater than the distance between each said pivot axis and each said second side contacting said chair supporting surface, whereby said chair has a greater height in said first position and a lesser height in said second position of said support members.

2. An adjustable height chair, as claimed in claim 1, wherein the distances between said first pivot axis and said first and second sides contacting said chair supporting surface of said first support member are substantially equal to the corresponding distances between said second pivot axis and said first and second sides contacting said chair supporting surface of said second support member.

3. An adjustable height chair, as claimed in claim 1, wherein said first and second pivot axes are substantially coaxial.

4. An adjustable height chair, as claimed in claims 2 or 3, wherein said first and second pivot means each comprises shaft means projecting sidewardly from said seat means toward said support member and bearing means in said support member receiving said shaft means for pivotally connecting said support member to said seat means for relative pivotal movement therebetween about said shaft means as said pivot axis.

5. An adjustable height chair, as claimed in claim 4, wherein each said pivot means further includes an arcuate recess formed in said support member, said shaft means extending into said recess, stop means rigidly mounted on said shaft means in said recess for pivotal movement along the arcuate path defined by said recess as said support member pivots relative to said seat means about its pivot axes.

6. An adjustable height chair, as claimed in claim 5, wherein said arcuate recess substantially defines the sector of a circle and said shaft extends into said sector shaped recess at its vertex.

7. An adjustable height chair, as claimed in claim 6, wherein the radial walls of said sector define stops limiting relative pivotal movement of said support member and said seat means.

8. An adjustable height chair, as claimed in claim 7, wherein said stop means abuts a first radial wall of said sector shaped recess in said first position of said support members.

9. An adjustable height chair, as claimed in claim 7, wherein said stop means abuts a second radial wall of said sector shaped recess in said second position of said support members.

10. An adjustable height chair, as claimed in claim 7, including means for pivoting said seat means relative to said support members in their first and second positions for pivoting said stop member into contact with said first and second radial walls of said sector shaped recess for adjusting said chair to its greater and lesser heights.

11. An adjustable height chair, as claimed in claim 4, wherein said seat means comprises an elongated generally planar seat portion and an elongated generally planar back supporting portion, said seat and back supporting portions intersecting at an angle for defining a seating area arranged for accomodating an occupant of said chair.

12. An adjustable height chair, as claimed in claim 11, including means for pivoting said seat means about said pivot axes for interchanging the anatomical supporting function of said seat portion and said back supporting portion.

13. An adjustable height chair, as claimed in claim 12, wherein the length of said seat portion is greater than the length of said back supporting portion.

14. An adjustable height chair, as claimed in claim 12, wherein the length of said back supporting portion is greater than the length of said seat portion.

15. An adjustable height chair, as claimed in claim 11, wherein said shaft means projects from said seat means proximate the intersection of said seat portion and said back supporting portion.

16. An adjustable height chair, as claimed in claim 15, including shaft supporting means on opposite sides of said seat means bridging the intersection of said seat portion and said back supporting portion, said shaft means projecting sidewardly from said shaft supporting means.

17. An adjustable height chair, as claimed in claims 1, 2 or 3, wherein each said support member comprises a generally rectangular slab.

18. An adjustable height chair, as claimed in claim 4, wherein each said support member comprises a generally rectangular slab.

19. An adjustable height furniture unit comprising an adjustable height table and at least one adjustable height chair, said table and chair being adjustable between greater and lesser heights relative to a support surface, said table at its greater height being functionally compatible with said chair at its greater height and said table at its lesser height being functionally compatible with said chair at its lesser height, said adjustable height table having a table top and a table top support structure, the table top support structure comprising at least two spaced support elements and pivot means pivotally connecting said support elements to the underside of the table top for pivotal movement of each said support element about a pivot axis, each said support element having a pair of opposite relatively short sides and a pair of opposite relatively long sides defining a generally rectangular cross-section in a plane generally perpendicular to its pivot axis, said support elements being pivotable about their respective pivot axes between a first position wherein a long side of each support element contacts the underside of said table top and a second position wherein a short side of each support element contacts the underside of said table top, whereby said table has a greater height in said second position and a lesser height in said first position of said support elements, said adjustable height chair having a seat means and a seat means support structure, the seat means support structure comprising first and second support members arranged on opposite sides of said seat means and first and second pivot means having first and second generally parallel pivot axes for pivotally connecting said support members to said seat means, each said support member having a pair of opposite first sides and a pair of opposite second sides defining a generally rectangular cross-section in a plane generally perpendicular to its pivot axis, said support members being pivotable relative to said seat means about their respective pivot axes between a first position wherein a first side of each support member contacts the support surface and a second position wherein a second side of each support member contacts the support surface, the distance between each said pivot axis and each said first side contacting said support surface being greater than the distance between each said pivot axis and each said second side contacting said support surface, whereby said chair has a greater height in said first position and a lesser height in said second position of said support members;

said seat means comprising intersecting and angularly arranged seat and back supporting portions, said seat portion of said chair at its greater height adapted to be disposed under and spaced sufficiently below the underside of said table top with the table at its greater height for comfortably accomodating an occupant of said chair seated at said table.

* * * * *